US005415342A

United States Patent [19]

Harrelson

[11] Patent Number: 5,415,342

[45] Date of Patent: May 16, 1995

[54] CONTAINER WITH ARTICLE RETAINING TABS

[75] Inventor: Glen R. Harrelson, Roswell, Ga.

[73] Assignee: Riverwood International Corporation, Atlanta, Ga.

[21] Appl. No.: 310,135

[22] Filed: Sep. 21, 1994

[51] Int. Cl.[6] ..... B65D 5/32; B65D 5/49

[52] U.S. Cl. ..... 229/120.38; 229/23 R; 229/165; 229/169; 229/172; 229/182

[58] Field of Search ..... 229/23 R, 109, 120.38, 229/165, 169, 172, 182, 915; 206/565

[56] References Cited

U.S. PATENT DOCUMENTS

| | | | |
|---|---|---|---|
| 2,568,204 | 9/1951 | Reeser | 229/169 |
| 2,657,849 | 11/1953 | Paul et al. | 229/23 R |
| 2,998,909 | 9/1961 | Anderson, Jr. et al. | 229/120.38 |
| 3,307,767 | 3/1967 | Humphrey et al. | 229/23 R |
| 3,373,921 | 3/1968 | Crane | 229/23 R |
| 4,058,249 | 11/1977 | Buck | 729/915 |
| 4,372,476 | 2/1983 | Harned et al. | 229/915 |
| 4,932,586 | 6/1990 | Young et al. | 229/23 R |
| 4,993,623 | 2/1991 | Kelly et al. | 229/23 R |
| 5,361,974 | 11/1994 | Earl et al. | 229/23 R |

*Primary Examiner*—Gary E. Elkins

[57] ABSTRACT

A shipping container formed by wrapping a slotted flexible sheet about rigid end panels having upper corner projections that extend through the slots. The side panels of the container are of multi-ply construction, with retaining tabs foldably connected to the inner plies. The retaining tabs are for the purpose of contacting the lower portion of smaller containers packaged within the shipping container and preventing the smaller containers from shifting toward the side panels during shipment and handling.

14 Claims, 3 Drawing Sheets

CONTAINER WITH ARTICLE RETAINING TABS

FIELD OF THE INVENTION

This invention relates to packaging and shipping containers which need not be fully enclosed but must be sturdy enough to protect the contents, typically produce, during handling and shipment. More particularly, the invention relates to a container of this type which is capable of stabilizing smaller containers packaged within the main container.

BACKGROUND OF THE INVENTION

Bulk products such as produce are often packaged in containers comprised of rigid end panels about which a flexible cover sheet is wrapped in order to form the bottom, side and top panels. The end panels include stacking projections on their upper or lower edges and stacking recesses on their opposite edge. When the containers are stacked, the projections from one container fit into the recesses of the next higher or lower container. The flexible sheet includes slots for receiving the stacking projections and the corners of the end panels. Means are also provided on the end panels for holding the ends of the sheet in place. Typically, the ends of the sheet may overlap to form a fully enclosed container or they may be spaced from each other to provide a partially open top panel.

Although such containers function quite well when used to package bulk products, problems arise when they are used to package smaller containers filled with bulk products. The smaller containers are typically plastic baskets filled with small articles of produce, such as berries or cherry tomatoes. Because the sides of the baskets are normally inwardly tapered, the basket bottoms are spaced from each other as well as from the side panels of the main container. This arrangement permits the baskets to shift or tilt during shipment and handling of the larger main containers, resulting in potential damage to the contents of the baskets.

A main object of this invention is to provide a shipping container which makes use of the basic design concept described above, but which can be modified when used to package smaller containers of bulk materials to stabilize the smaller containers and prevent them from moving within the main container.

BRIEF SUMMARY OF THE INVENTION

The improved container of the invention includes the basic features of the type of container discussed above, that is, bottom and side panels formed from a flexible sheet attached to and extending between spaced relatively rigid end panels. The container further comprises retaining tabs foldably connected to the side panels. The retaining tabs extend downwardly and inwardly so as to contact smaller containers packaged within the shipping container to stabilize the smaller containers against movement toward the side panels. This arrangement is especially effective in stabilizing small tapered containers, such as produce baskets, against movement.

The side panels of the shipping container are normally of multi-ply construction, with the retaining tabs being foldably connected to the inner plies of the side panels.

The shipping container is easily formed and is economical to produce, since the design does not require the use of additional blank material to form the retaining tabs.

These and other features and aspects of the invention, as well as its various benefits, are made more clear in the detailed description of the preferred embodiments which follows.

DETAILED DESCRIPTION OF THE PREFERRED EMBODIMENTS

Figure 1:
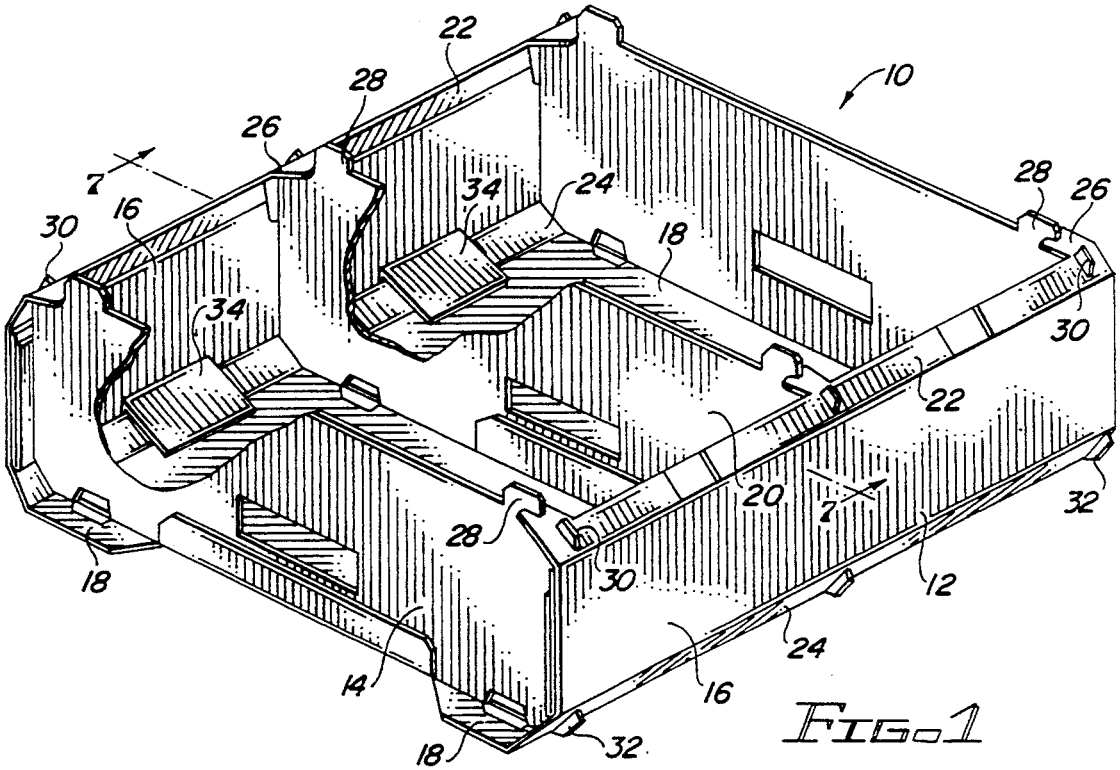
FIG. 1 is a pictorial view of the container of the invention, with portions of an end panel and an intermediate cross panel removed in order to illustrate the retaining tabs on one side of the container.

Referring to FIG. 1, a container 10 comprised of a flexible cover sheet 12 and rigid end panels 14 includes side panels 16 and bottom panel 18 formed by the cover sheet. An intermediate cross panel 20 similar to the end panels 14 divides the container into two bins. It should be understood that the invention is not limited to a two-bin construction, but may be incorporated in containers which have no cross panels or have more than one cross panel. The flexible cover sheet may be formed of paperboard of a thickness normally used in the manufacture of carriers from foldable paperboard blanks, while the end panels may be formed of thick paperboard, pressed board or any other readily available economical rigid material.

Connected to the side panels 16 are upper bevel panels 22 and lower bevel panels 24. Locking tabs 26 connected to the upper bevel panels engage the outer edges of stacking projections 28 on the end and cross panels to hold the ends of the cover sheet in place, as described in more detail below, while upper shoulder projections 30 and lower support feet 32 on the end and cross panels extend through slots in the upper and lower bevel panels. In addition, retaining tabs 34 extend from the side panels in each bin of the container down to the bottom panel. Although not visible in FIG. 1, it will be understood that retaining tabs also extend from the side panels at the right of the drawing figure.

Figure 2:
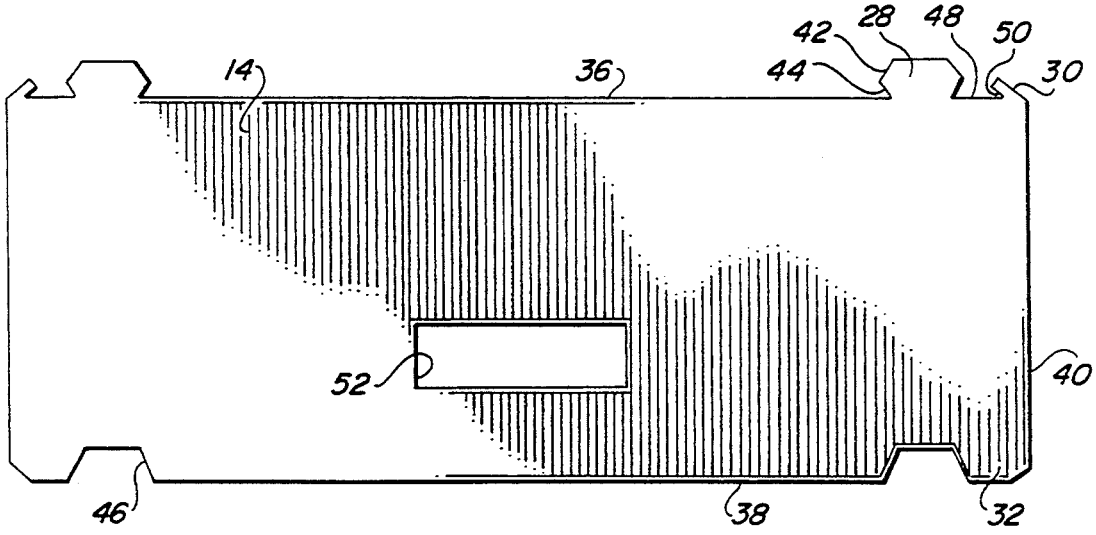
FIG. 2 is a plan view of an end panel incorporated in the container of FIG. 1.

Since all the end panels and cross panels preferably are identical, the end panel 14 shown in FIG. 2 is representative of all such panels. It is of generally rectangular shape, having upper and lower edges 36 and 38, respectively, and side edges 40. The stacking projections 28 include upper outwardly tapered side edge portions 42 and lower inwardly tapering side edge portions 44. Two similarly shaped stacking recesses 46 are formed in the lower edge 18 so as to be aligned with the projections 28. Adjacent each projection 28 is a recess 48, one side edge of which is comprised of the lower side edge portion 44 of the projection and the other side edge of which is comprised of the tapered edge 50 of the shoulder 30. An opening 52 provides a hand grip for lifting the container and also allows air to flow into the container to keep packaged produce in fresh condition.

Figure 3:
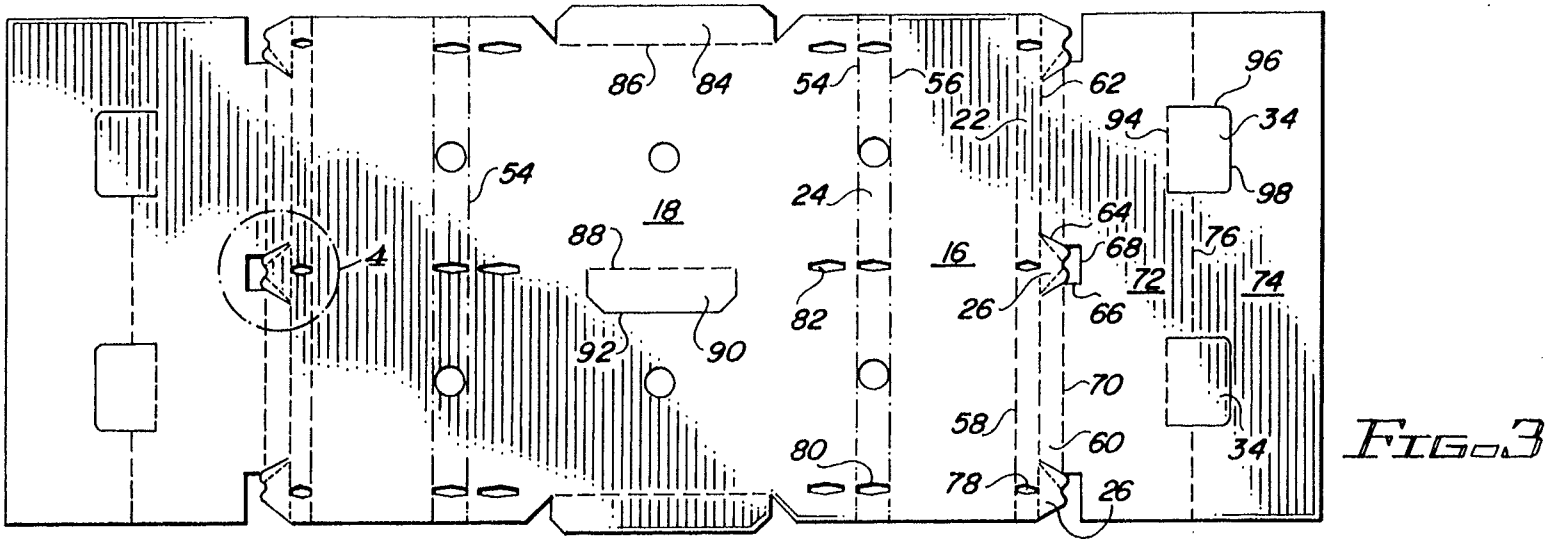
FIG. 3 is a plan view of the blank used in forming the cover sheet employed in the container of FIG. 1.

The blank used to form the cover sheet of the container of FIG. 1 is shown in FIG. 3, wherein similar reference numerals to those used in FIG. 1 denote similar elements. The substantially rectangular blank includes a series of parallel fold lines which allow the sheet to be folded about spaced end panels and an intermediate cross panel to form the bottom and side panels of the container. Thus, a centrally located bottom panel section 18 is connected by fold lines 54 to lower bevel panel sections 24, which in turn are connected by fold lines 56 to side panel sections 16. Upper bevel panel sections 22 are connected to the side panel sections 16 by fold lines 58 and to bevel panel reinforcement sections 60 by fold lines 62. The locking tabs 26, which are also connected to the upper bevel panel sections by the fold lines 62, are defined by slits 64 extending from the fold lines 62 and by edges 66 which extend into cutouts 68. The bevel panel reinforcement sections 60 are connected by fold lines 70 to a first side panel reinforcement section 72, which is connected to a second side panel reinforcement section 74 by fold lines 76. Although reference numerals have been used to denote only those elements on the right side of the blank, it will be understood that the left side of the blank is identical to the right side.

The upper bevel panel sections 22 include slots 78 for receiving the corner shoulders 30 of the end and intermediate cross panels. Slots 80 are also provided in the lower bevel panel sections 24 for receiving the support feet 32 and, in addition, slots 82 are provided in the bottom panel section 18 to allow passage of the stacking projections of the next lower container in a stacked arrangement. End glue flaps 84 are connected to the bottom panel section by fold lines 86. Also connected to the bottom panel section by fold line 88 is intermediate glue flap 90, which is defined by the slit 92.

The retaining tabs 34 are connected to the first side panel reinforcing section 72 by fold lines 94 and are further defined by slits 96, which extend into the second side panel reinforcing section 74, and by slit 98 which connects the ends of slits 96.

Figure 4:
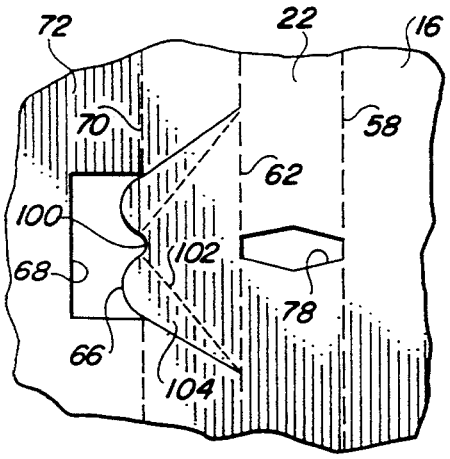
FIG. 4 is an enlarged plan view of the area of FIG. 3 within the circle 4, showing the fastening tab therein.

The central locking tab 26 is shown in greater detail in FIG. 4, which better illustrates the notch 100 at its outer end and the fold lines 102 extending from each side of the notch to the bevel panel 22 to form wings or flaps 104 on the locking tab.

Figure 5:
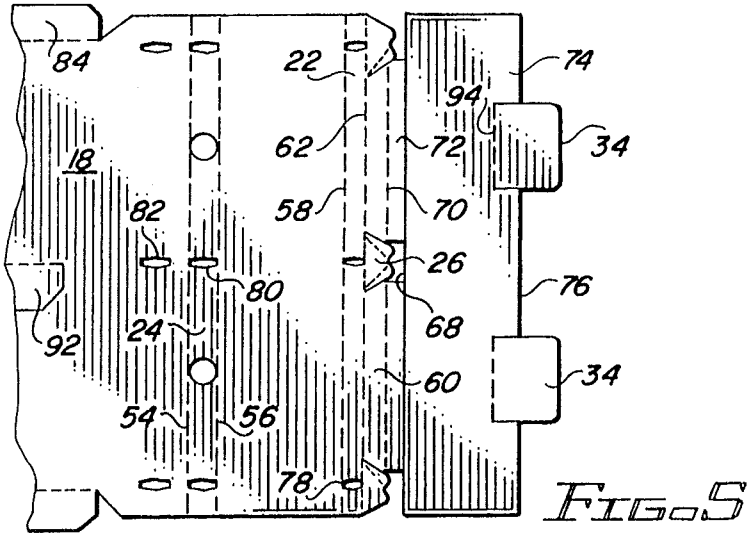
FIG. 5 is a partial plan view of the blank of FIG. 3 after an initial folding step has been completed.

To fabricate the container of FIG. 1, glue is applied to either the first or second reinforcing side panel sections 72 and 74 and to the side panel sections 16. The second reinforcing side panel section 74 at each end of the blank is then pivoted about fold line 76 and adhered to the first reinforcing side panel section 72 to form the intermediate stage of fabrication shown in FIG. 5. As illustrated, folding of the blank along the fold lines 76 results in the retaining tabs extending out beyond the adhered reinforcing panel sections. The combined reinforcing panel sections are then pivoted about fold line 62 and adhered to the side panel sections 16. Each end of the blank at this point appears as in FIG. 6.

Figure 6:
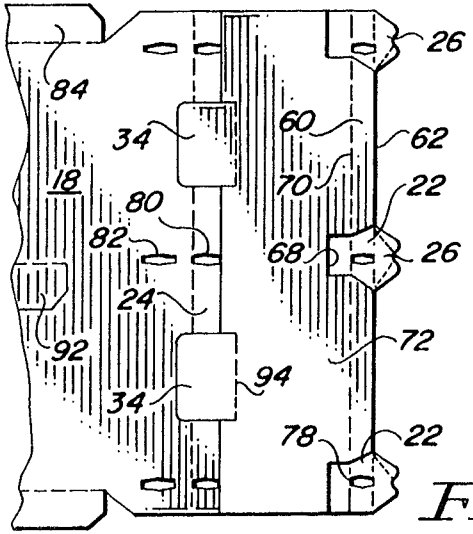
FIG. 6 is a partial plan view of the blank of FIG. 3 after a second folding step has been completed.

Two end panels 14 are then centered and glued to the end glue flaps 84 and a similar intermediate cross panel 20 is centered and glued to the intermediate glue flap 90. After folding the glue flaps up so that the panels 14 and 20 are upright, the lower bevel panel sections and the side panel sections of the blank of FIG. 6 are folded up so that the corner portions of support feet 32 extend through the slots 80 in the lower bevel panel sections 24. The upper bevel sections 22 are then folded along fold lines 62 so that the shoulders 30 of the panels 14 and 20 extend through the slots 78 in the upper bevel panel sections 22.

To secure the locking tabs in place, they are positioned so that the notch 100 contacts the base of the outer tapered edge 44 of the stacking projection 28. Because the tabs are relatively short they extend only a short distance into the open space through which the container is loaded and require a minimum of blank material. By folding the wings 104 down about the fold lines 102, the notched end of the locking tab can be moved down into position so that when the force moving the locking tab into position is removed, the edge 44 prevents upward movement of the locking tab. Because the upper bevel panels 22 are held in place by the shoulders 30, much of the stress which would otherwise be transferred to the locking tabs is relieved. As illustrated in FIG. 3, the end locking tabs contain only one inwardly facing wing. This is a preferred arrangement for the end locking tabs, as the absence of a fold line in the outer portion of the tab makes these critical tabs more rigid. It has been found that folding of the single wing in this case is enough to enable the tab to be positioned into place against the tapered edge of the stacking projection.

The folding and gluing steps described above produce the container illustrated in FIG. 1. It can be seen from FIG. 6 that the glued reinforcing panel sections 72 and 74 stop short of the lower bevel panel sections 24 and so do not interfere with the formation of the lower bevel panels. The retaining tabs 34, however, extend beyond the lower bevel panel sections. This results in the ends of the retaining tabs contacting the bottom panel section 18 and, while pivoting about the fold lines 94, sliding inwardly over the bottom panel section surface as the lower bevel panels are formed. The retaining tabs are thus moved into the final position shown in FIG. 1.

Figure 7:
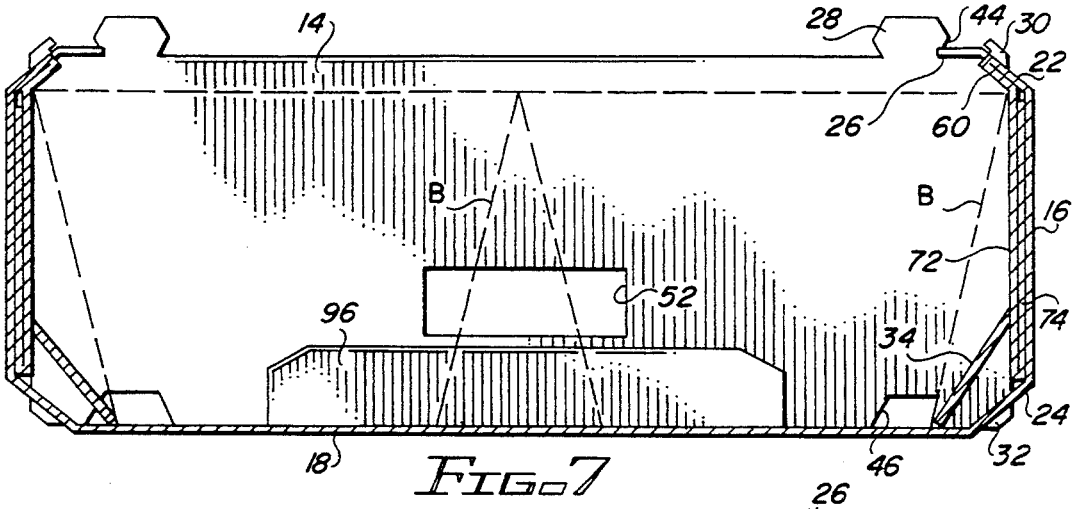
FIG. 7 is a transverse sectional view taken along line 7–7 of FIG. 1, showing adjacent baskets in the container in phantom lines.

The sectional view of FIG. 7 illustrates the location of the retaining tabs in connection with two rows of produce baskets B, shown in phantom. The sides of the baskets are typically tapered, which means that the smaller basket bottoms are spaced from the sides of the container and would normally be under no restraint against movement caused by forces arising during shipping and handling. The baskets in this case, however, are stabilized by the retaining tabs 34 which contact the outer bottom portions of the baskets. Typically, the retaining tabs contact the bottom panel of the container and act as wedges between the side panels and the baskets, thereby preventing movement of the baskets.

As best shown in FIG. 7, the first and second reinforcing side panel sections 72 and 74 and the side panels 16 provide a three-ply wall capable of resisting the forces caused by heavy stacked containers and by being tightly strapped to a pallet.

Figure 8:
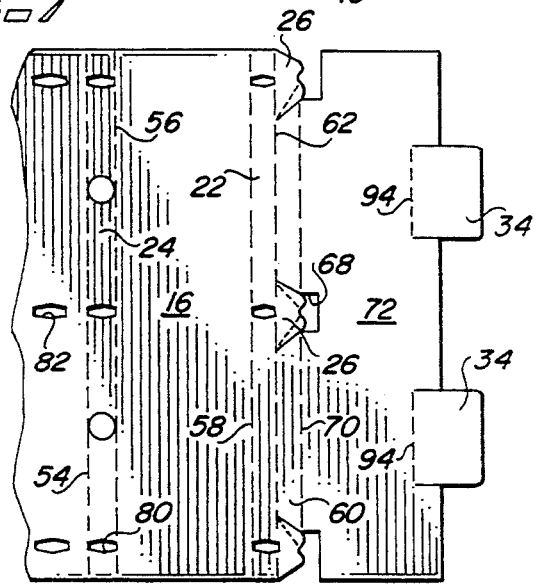
FIG. 8 is a partial plan view of a blank for forming a modified container.
Figure 9:
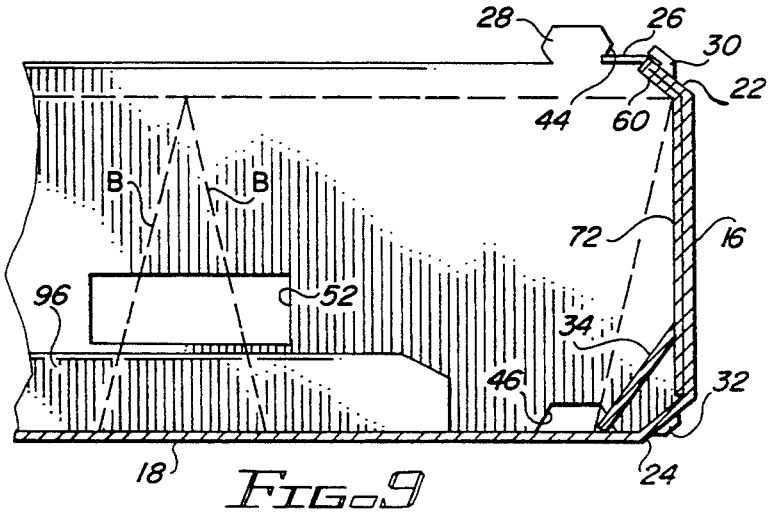
FIG. 9 is a partial transverse sectional view similar to that of FIG. 7, but showing a modified container formed from the blank of FIG. 8.

Containers which do not require side panels of three-ply construction may be formed from the blank of FIG. 8. In this arrangement the blank is similar to the blank of FIG. 3 except that the second side panel reinforcement panel section has been eliminated, leaving only a single reinforcement panel section 72. The retaining tabs 34 are connected to the reinforcement panel section in the same manner as in the first embodiment and function in the same manner. A partial sectional view of a container formed from the blank is shown in FIG. 9. The retaining tabs contact adjacent produce baskets as in FIG. 7, but the side panels of the container are of only two-ply construction, which is sufficient to meet the strength requirements of many shipping containers.

As indicated earlier, although the container of the invention has been shown for the purpose of illustration as including a single interior cross panel dividing the container into two bins, it may have no interior cross panel at all, in which case the container will present only a single bin, or it may have more than one interior cross panel to provide additional bins.

It can now be appreciated that the invention provides a container which is capable of stabilizing smaller baskets or other containers packaged inside a main shipping container against movement during shipping and handling. The invention also produces a container which can be provided with side panels of either two- or three-ply construction. It should be obvious that although preferred embodiments of the invention have been described, changes to certain details of the embodiments can be made without departing from the spirit and scope of the invention defined in the appended claims.

What is claimed is:

1. A shipping container, comprising:

two spaced, substantially parallel, relatively rigid end panels;

a flexible sheet forming bottom and side panels extending between the end panels;

means for attaching the flexible sheet to the end panels; and a retaining tab foldably connected to each side panel, each retaining tab extending downwardly and inwardly from the side panel associated therewith, the retaining tabs being capable of contacting smaller containers which may be packaged within the shipping container to stabilize such smaller containers against movement toward the side panels.

2. A shipping container as defined in claim 1, wherein the side panels are of multi-ply construction, each side panel having an outer ply and an inner ply, the retaining tabs being foldably connected to the inner plies of the side panels.

3. A shipping container as defined in claim 2, wherein each side panel includes a lower inwardly sloped portion, the retaining tabs extending beyond said sloped portions to the bottom panel.

4. A shipping container as defined in claim 3, wherein each end panel includes two lower corner areas comprising support feet, the support feet extending through slots in the lower sloped portions of the side panels.

5. A shipping container as defined in claim 3, wherein each side panel includes an upper inwardly sloped portion and each end panel includes two upper corner areas comprising shoulder projections, the shoulder projections extending through slots in the upper sloped portions of the side panels.

6. A shipping container as defined in claim 2, wherein the side panels are of three-ply construction, each side panel having a third ply between the outer ply and the inner ply.

7. A shipping container as defined in claim 1, wherein each end panel includes upwardly extending projections and wherein the means for attaching the flexible sheet to the end panels includes locking tabs on the sheet engaging the upwardly extending projections.

8. A shipping container as defined in claim 1, including at least one intermediate transverse panel similar to the end panels and being substantially parallel thereto, means for attaching the flexible sheet to the intermediate transverse panel, the intermediate transverse panel dividing the interior of the shipping container into separate bins, the side panel of each bin having a retaining tab foldably connected thereto.

9. A shipping container, comprising:

two spaced, substantially parallel, relatively rigid end panels;

a flexible sheet forming bottom and side panels extending between the end panels;

means for attaching the flexible sheet to the end panels;

a plurality of smaller containers packaged within the shipping container; and a retaining tab foldably connected to each side panel, each retaining tab extending downwardly and inwardly from the side panel associated therewith, each retaining tab contacting one of the smaller containers adjacent thereto to stabilize the smaller container against movement toward the side panels.

10. A shipping container as defined in claim 9, wherein the side panels are of multi-ply construction, each side panel having an outer ply and an inner ply, the retaining tabs being foldably connected to the inner plies of the side panels.

11. A shipping container as defined in claim 10, wherein each side panel includes a lower inwardly sloped portion, the retaining tabs extending beyond said sloped portions to the bottom panel, and each end panel includes two lower corner areas comprising support feet, the support feet extending through slots in the lower sloped portions of the side panels.

12. A shipping container as defined in claim 11, wherein each side panel includes an upper inwardly sloped portion and each end panel includes two upper corner areas comprising shoulder projections, the shoulder projections extending through slots in the upper sloped portions of the side panels.

13. A shipping container as defined in claim 10, wherein the side panels are of three-ply construction, each side panel having a third ply between the outer ply and the inner ply, the outer ply being foldably connected to the inner ply and the inner ply being foldably connected to the third ply.

14. A shipping container as defined in claim 9, including at least one intermediate transverse panel similar to the end panels and being substantially parallel thereto, means for attaching the flexible sheet to the intermediate transverse panel, the intermediate transverse panel dividing the interior of the shipping container into separate bins, the side panel of each bin having a retaining tab foldably connected thereto.

* * * * *